US006057642A

United States Patent [19]

Konuma

[11] Patent Number: 6,057,642

[45] Date of Patent: May 2, 2000

[54] FIELD EMISSION DEVICE WITH TILTED CATHODES

[75] Inventor: Kazuo Konuma, Tokyo, Japan

[73] Assignee: NEC Corporation, Japan

[21] Appl. No.: 08/878,272

[22] Filed: Jun. 18, 1997

[30] Foreign Application Priority Data

Jun. 19, 1996 [JP] Japan ..... 8-158633

[51] Int. Cl.[7] ..... H01J 1/02; H01J 1/62

[52] U.S. Cl. ..... 313/495; 313/309; 313/336; 313/351; 313/238

[58] Field of Search ..... 313/308, 309, 313/310, 336, 351, 495, 355, 238, 252

[56] References Cited

U.S. PATENT DOCUMENTS

| | | | |
|---|---|---|---|
| 4,940,916 | 7/1990 | Borei et al. | 313/309 |
| 5,019,003 | 5/1991 | Chason | 313/309 |
| 5,578,901 | 11/1996 | Blanchet-Fincher et al. | 313/309 |

FOREIGN PATENT DOCUMENTS

| | | | |
|---|---|---|---|
| 2297844 | 12/1990 | Japan | H01J 31/15 |
| 5282990 | 1/1993 | Japan | H01J 1/30 |
| 5182583 | 7/1993 | Japan | H01J 9/02 |
| 5198254 | 8/1993 | Japan | H01J 1/30 |
| 6290703 | 10/1994 | Japan | H01J 1/30 |
| 7201273 | 8/1995 | Japan | H01J 1/30 |
| 8106848 | 4/1996 | Japan | H01J 1/30 |
| 7176264 | 7/1996 | Japan | H01J 9/02 |
| 8287820 | 11/1996 | Japan | H01J 1/30 |
| 8315721 | 11/1996 | Japan | H01J 1/30 |
| 963489 | 3/1997 | Japan | H01J 23/04 |

OTHER PUBLICATIONS

Gray et al; "A Vacuum Field Effect Transistor Using Silicon Field Emitter Arrays"; 1986; pp. 776–779; Naval Research Laboratory; IEDM Technical Digest.

Spindt et al., "Physical Properties of Thin–Film Field Emission Cathodes with Molybdenum Cones"; Dec. 1976; pp. 5248–5263; Journal of Applied Physics, vol. 47, No. 12.

*Primary Examiner*—Sandra O'Shea
*Assistant Examiner*—Joseph Williams
*Attorney, Agent, or Firm*—Hayes, Soloway, Hennessey, Grossman & Hage, P.C.

[57] ABSTRACT

A field emission device is provided, which is able to prevent the inclination of emission direction of electrons. An insulating layer is formed on a first main surface of a substrate. A conductive layer with a gate electrode part and an interconnection part is selectively formed on the insulating layer. A second conductive layer is formed on the second main surface of the substrate. The first part has a window to expose the insulating layer. The insulating layer has a hole to expose the first main surface of the substrate. The hole is located just below the window of the conductive layer. A conical cathode is formed on the exposed first main surface of the substrate in the bole. The central axis of the cathode, which penetrates the tip of the cathode, is tilted with respect to a normal of the second conductive layer toward an opposite side to the interconnection part of the conductive layer. The direction of the emitted electrons is approximately parallel to the normal of the second conductive layer.

6 Claims, 3 Drawing Sheets

FIELD EMISSION DEVICE WITH TILTED CATHODES

BACKGROUND OF THE INVENTION

1. Field of the Invention

The present invention relates to a field emission device and more particularly, to a field emission device that is able to readily control the emission direction of electrons independent of the unbalance or asymmetry in pattern of a gate electrode.

2. Description of the Prior Art

Conventionally, various types of field emission devices have been developed; typical examples of which were reported by C. A. Spindt et al. in the article, Journal of Applied Physics, Vol. 47, No. 12, pp. 5248–5263, published in December 1976, and by H. F. Gray et al. in the article, 1986 IEDM Technical Digest, pp. 776–779, published in 1986.

An example of the conventional field emission devices is shown in FIG. 1, which includes a semiconductor substrate 31 having an upper main surface 31*b* and a lower main surface. or back surface 31*a*. The first and second main surfaces 31*b* and 31*a* are parallel to each other.

An insulating layer 32 is formed on the upper main surface 31*b* of the substrate 31. A conductive layer 42 is selectively formed on the insulating layer 32. The conductive layer 42 has a part serving as a gate electrode 33, a part serving as a bonding pad (not shown), and a part serving as an interconnection 38 for electrically interconnecting the gate electrode 33 and the bonding pad.

The gate electrode 33 has circular apertures or windows 33*a* arranged in a matrix array to expose the underlying insulating layer 32. The insulating layer 32 has circular penetrating holes 34 to expose the underlying upper main surface 31*b* of the substrate 31. The holes 34 are arranged at the locations just below the corresponding windows 33*a* of the gate electrode 33.

Cathodes 35, which are made of a conductive metal such as molybdenum (Mo), are formed on the exposed upper main surface 31*b* of the substrate 31 in the corresponding holes 34 of the insulating layer 32, respectively. Each of the cathodes 35 has a shape of a sharp-pointed cone. The tips of the cathodes 35 are located in the vicinity of the interface of the gate electrode 33 and the insulating layer 32.

A conductive layer 36, which is made of a metal such as aluminum (Al), is formed on the back surface 31*a* of the substrate 31. This conductive layer 36 serves as a back, electrode. The layer 36 is in Ohmic contact with the substrate 31.

When a positive electric potential with respect to the conical cathodes 35 is applied to the gate electrode 33 in a vacuum atmosphere, electrons 37 are emitted or extracted from the vicinity of the tips of the cathodes 35 due to the "field emission" phenomenon. The potential is applied to the cathodes 35 through the back electrode 36 and the substrate 31. The emitted electrons 37 movre upward along the paths 37*a* in the space near the gate electrode 33, traveling toward an anode (not shown) along an arrow 40.

The condition for the field emission phenomenon of the electrons 37 is determined according to the shape of the cathodes 35 and the distance between the gate electrode 33 and the corresponding cathodes 35.

With the conventional field emission device shown in FIG. 1, there is a problem that the overall emission direction 40 of the electrons 37 is largely inclined toward the left-hand side in FIG. 1 to a normal of the surface 36*a* of the back electrode 36, resulting in the emission direction 40 not perpendicular to the surface 36*a*, This problem is caused by the following fact:

Specifically, the upper conductive layer 42 is partially formed on the insulating layer 32 to be asymmnetric with the cathodes 35. Therefore, the electric field 39 in a spatial region located just over the conductive layer 42 (which is mainly positioned on the left-hand side in FIG. 1) is strongly affected by the electric potential of the conductive layer 42, not the electric potential of the substrate 31, i.e., the cathodes 35. On the other hand, the electric field in the remaining region located outside the conductive layer 42 is affected by the electric potential of the substrate 31 through the insulating layer 32, To correct the above inclination of the overall emission direction 40 of the electrons 37, there has been known a method that an additional electrode with the same geometric shape as that of the conductive layer 42 is provided to be apart from and opposite to the layer 42. However, this method will cause another problem of an increase in parasitic capacitance.

SUMMARY OF THE INVENTION

Accordingly, an object of the present invention is to provide a field emission device that is able to solve the above problem of inclination of the emission direction of electrons.

Another object of the present invention is to provide a field emission device in which the overall emission direction of electrons can be approximately perpendicular to a back surface of a substrate independent of the asymmetry of unbalance of a conductive layer serving as a gate electrode.

The above objects together with others not specifically mentioned will become clear to those skilled in the art from the following description.

A field emission device according to the present invention is comprised of a substrate with a first main surface and a second main surface, an insulating layer formed. on the first main surface of the substrate, and a conductive layer selectively formed on the insulating layer.

The conductive layer has a first part serving as, a gate electrode and a second part serving as an interconnection for the gate electrode. The first part of the conductive layer has a window to expose the underlying insulating layer. The conductive layer has an asymmetric plan shape with respect to the first part.

The insulating layer has a hole to expose the underlying first main surface of the substrate. The hole is located just below the window of the conductive layer.

A cathode is formed on the exposed first main surface of the substrate in the hole of the insulating layer. The cathode has a conical shape the bottom of which is connected to the first main surface of the substrate and the tip of which is directed toward the gate electrode.

The central axis of the cathode, which penetrates the tip of the cathode, is tilted with respect to a normal of the second main surface of the substrate toward an opposite side to the second part of the conductive layer.

Electrons are emitted from the tip of the cathode to travel through the window of the conductive layer on application of a voltage across the conductive layer and the substrate.

The direction of the emitted electrons is approximately parallel to the normal of the second main surface of the substrate.

With the field emission device according to the present invention, the central axis of the cathode, which penetrates the tip of the cathode, is tilted with respect to the normal of the second main surface of the substrate toward the opposite side to the second part of the conductive layer.

Therefore, when the first and second main surfaces of the substrate are substantially parallel to each other, the distance between the tip of the cathode and the first part of the conductive layer (i.e., the gate electrode) is shorter in the opposite side to the second part (i.e., the interconnection) of the conductive layer than in the same side as that thereof. This means that the electric field in the vicinity of the tip of the cathode is stronger in the opposite side to the second part than in the same side thereof.

Accordingly, the number of the emitted electrons is greater in the opposite side to the second part than that in the same side thereof. The unbalance in the number of the emitted electrons cancels the unbalance in the electric-field distribution in the spatial region near the surface of the insulating layer.

As a result, the problem of inclination of the emission direction of electrons can be solved. This means that the emission direction of the electrons can be approximately perpendicular to the second or back surface of the substrat independent of the asymmetry in shape of the conductive layer.

Further, when the first and second main surfaces of the substrate are not parallel to each other, it is not necessary to incline the cathode itself. It is sufficient that the conductive layer is inclined toward the opposite side to the second part of the conductive layer with respect to the normal of the second main surface of the substrate.

The tilt of the emission direction of the electrons, which is due to the unbalance in the electric-field distribution in the spatial region near the surface of the insulating layer, is canceled by the tilt of the conductive layer with respect to the normal of the second main surface.

As a result, the problem of inclination of the emission direction of electrons can be solved. This means that the emission direction of the electrons can be approximately perpendicular to the second main surface of the substrate independent of the asymmetry in shape of the conductive layer.

In a preferred embodiment of the field emission device according to the invention, the first main surface of the substrate is parallel to the second main surface of the substrate, and the central axis of the cathode is tilted with respect to a normal of the first main surface of the substrate.

In this case, there is an additional advantage that this device can be obtained by simply forming the cathode to be inclined with respect to the normal of the first main surface of the substrate.

In another preferred embodiment of the field emission device according to the invention, the first main surface of the substrate is not parallel to the second main surface of the substrate, and the central axis of the cathode is perpendicular to the first main surface of the substrate.

In this case, there is an additional advantage that this device can be realized by simply polishing the second main surface of the substrate.

BRIEF DESCRIPTION OF THE DRAWINGS

In order that the invention may be readily carried into effect, it will now be described with reference to the accompanying drawings.

DETAILED DESCRIPTION OF THE PREFERRED EMBODIMENTS

Figure 1:
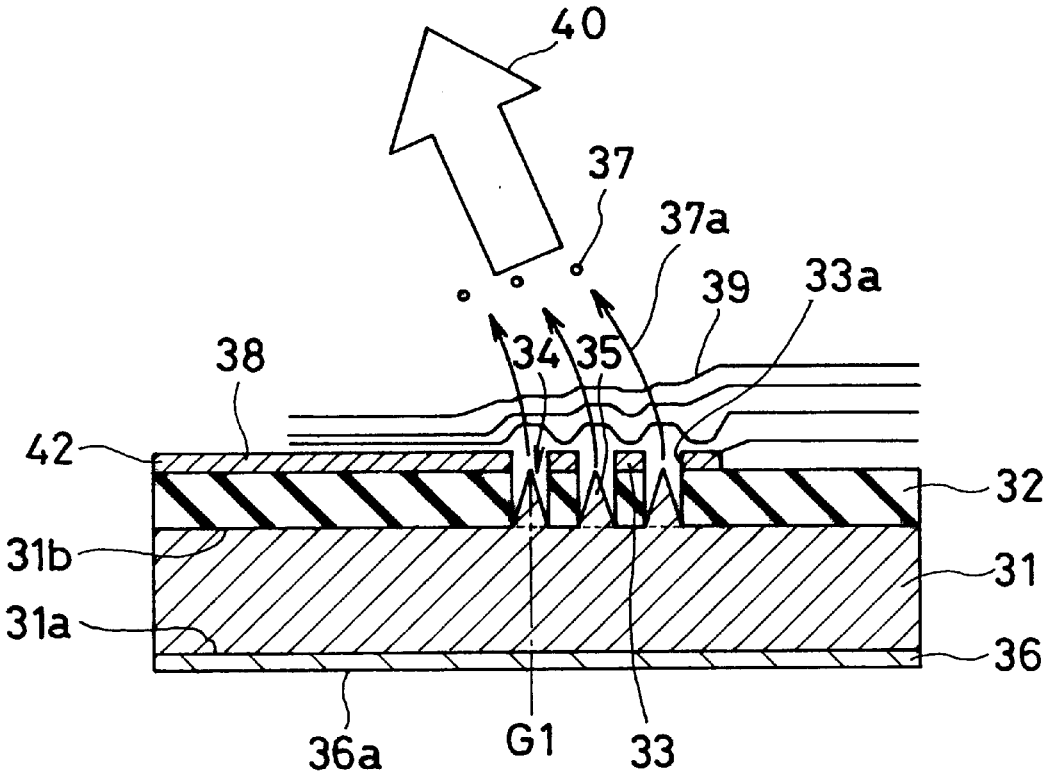
FIG. 1 PRIOR ART
FIG. 1 is a schematic cross sectional view of a conventional field emission device.

Preferred embodiments of the present invention will be described below referring to the drawings attached.

FIRST EMBODIMENT

Figure 2:
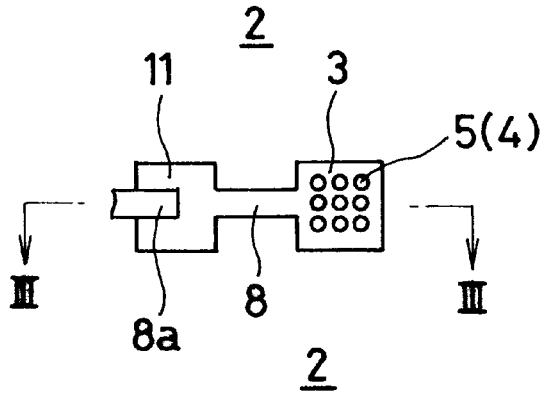
FIG. 2 is a schematic, partial plan view of a field emission device according to a first embodiment of the present invention.
Figure 3:
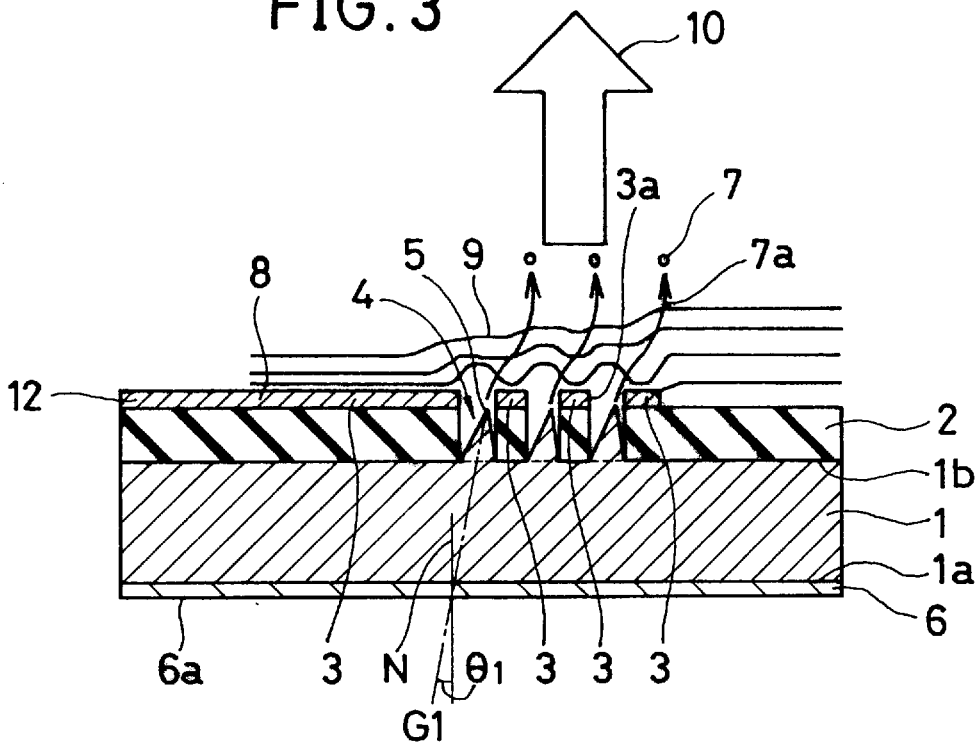
FIG. 3 is a schematic cross sectional view of the field emission device according to the first embodiment, in which the gate electrode is parallel to the back surface of the substrate.

As shown in FIGS. 2 and 3, a field emission device according to a first embodiment of the present invention includes a semiconductor substrate 1 having an upper main surface 1*b* and a lower main surface or back surface 1*a*. The first and second main surfaces 1*b* and 1*a* are parallel to each other.

An insulating layer 2 is formed on the first main surface 1*b* of the substrate 1.

A conductive layer 12 is selectively formed on the insulating layer 2. The conductive layer 12 has a plan shape as shown in FIG. 2. Specifically, the conductive layer 12 is formed by a first square part 3 serving as a gate electrode, a third square part 11 serving as a bonding pad, and a second rectangular part 8 serving as an interconnection for electrically interconnecting the gate electrod 3 and the bonding pad 11. An end of a bonding wire 8*a* is bonded onto the bonding pad 11.

The first part 3 of the conductive layer 12, which serves as the gate electrode, has circular apertures or windows 3*a* arranged in a matrix array to expose the underlying insulating layer 2. The second part or interconnection 8 and the third part or bonding pad are selectively located at one side of the first, part or gate electrode 3.

Another conductive layer 6, which is made of a metal such as aluminum (Al), is formed on the second main surface or back surface 1*a* of the substrate 1. The conductive layer 6 is parallel to the conductive layer 12. This conductive layer 6 serves as a back electrode. The layer 6 is in Ohmic contact with the substrate 1.

The insulating layer 2 has circular penetrating holes 4 to expose the underlying first main surface 1*b* of the substrate 1, The holes 4 are arranged at the locations just below the corresponding windows 3*a* of the gate electrode 3.

Cathodes 5, which are made of a conductive metal such as Mo, are formed on the exposed main surface 1*b* of the substrate 1 in the corresponding holes 4 of the insulating layer 2, respectively. Each of the cathodes 5 has a shape of sharp-pointed cone the bottom of which is connected to the upper main surface 1*b* of the substrate 1 and the tip of which is directed toward the gate electrode 3. The tips of the cathodes 5 are located in the vicinity of the interface of the gate electrode 3 and the insulating layer 2.

As clearly shown in FIG. 3, the central axis G1 of each of the cathodes 3, which penetrates its tip, is tilted by an angle $\theta_1$ with respect to a normal N of the second main surface of the substrate 1 toward an opposite side (right-hand side in FIG. 3) to the second part or interconnection 8 of the conductive layer 12.

When a voltage is applied across the upper and lower conductive layers 12 and 6, the electrons 7 are emitted from the tips of the cathodes 5 to travel through the windows 3*a* of the gate electrode 3 due to the field emission phenomenon.

With the field emission device according to the first embodiment, the central axis G1 of each of the cathodes 5 is tilted by the angle $\theta_1$ with respect to the normal N of the lower conductive layer 6 toward the opposite side to the interconnection 8 of the conductive layer 12.

Therefore, the distance between the tips of the cathodes 5 and the corresponding gate electrodes 3 is shorter in the opposite side to the interconnection 8 than in the same side thereof. This means that the obtainable electric field in the opposite side to the interconnection 8 is stronger than that in the same side thereof. the same side thereof.

Accordingly, the number of the emitted electrons 7 is greater in the opposite side to the interconnection 8 than in the same side thereof.

On the other hand, the electric-field distribution 9 in the space near the surfaces of the, insulating layer 2 and the upper conductive layer 12 becomes asymmetric with respect to the gate electrode 3 due to the asymmetric shape of the upper conductive layer 12, an additional electrode provided for any other purpose, and so on.

Therefore, the unbalance in number of the emitted electrons 7 (i.e., the tilt angle $\theta_1$) is adjusted to cancel the asymmetry or unbalance in the electric-field distribution in the spatial region near the surfaces of the insulating layer 2 and the upper conductive layer 12.

As a result, the problem of inclination of the overall emission direction 10 of the electrons 7 can be solved. This means that the overall emission direction 10 of the electrons 7 can be approximately perpendicular to the lower main surface 1*a* of the substrate 1 independent of the asymmetry of the upper conductive layer 12, by properly adjusting the tilt angle $\theta_1$ of the cathodes 5.

In addition, the overall emission direction 10 of the electrons 7 can be changed as necessary by adjusting the tilt angle $\theta_1$ of the cathodes 5. This means that the emission direction 10 of the electrons 7 can be readily controlled.

The cathodes 5 with a shape of a tilted cone can be realized in any one of the known, popular processes. For example, the same processes as disclosed in the article by Spindt et al. may be used, in which the metal deposition step for the cathodes 5 is performed while the substrate is inclined.

Typically, the electrons 7 emitted from the tip of each cathode 5 travels upward through a conical region with a solid angle of approximately 30°. Therefore, the tilt angle $\theta_1$ of each cathode 5 is optionally determined in such a way that the traveling electrons 7 do not collide with the gate electrode 3.

For example, a single-crystal silicon (Si) substrate with a square plan shape 2 mm×2 mm and a thickness of 600 $\mu$m may be used as the substrate 1. A silicon dioxide ($SiO_2$) layer with a thickness of 1 $\mu$m may be used as the insulating layer 2. A polycrystalline tungsten (W) layer with a thickness of 200 nm may be used as the conductive layer 12. The bottom diameter of the cathode 5 may be 1 $\mu$m. The tilt angle $\theta_1$ of the conical cathode 5 may be 5°.

SECOND EMBODIMENT

Figure 4:
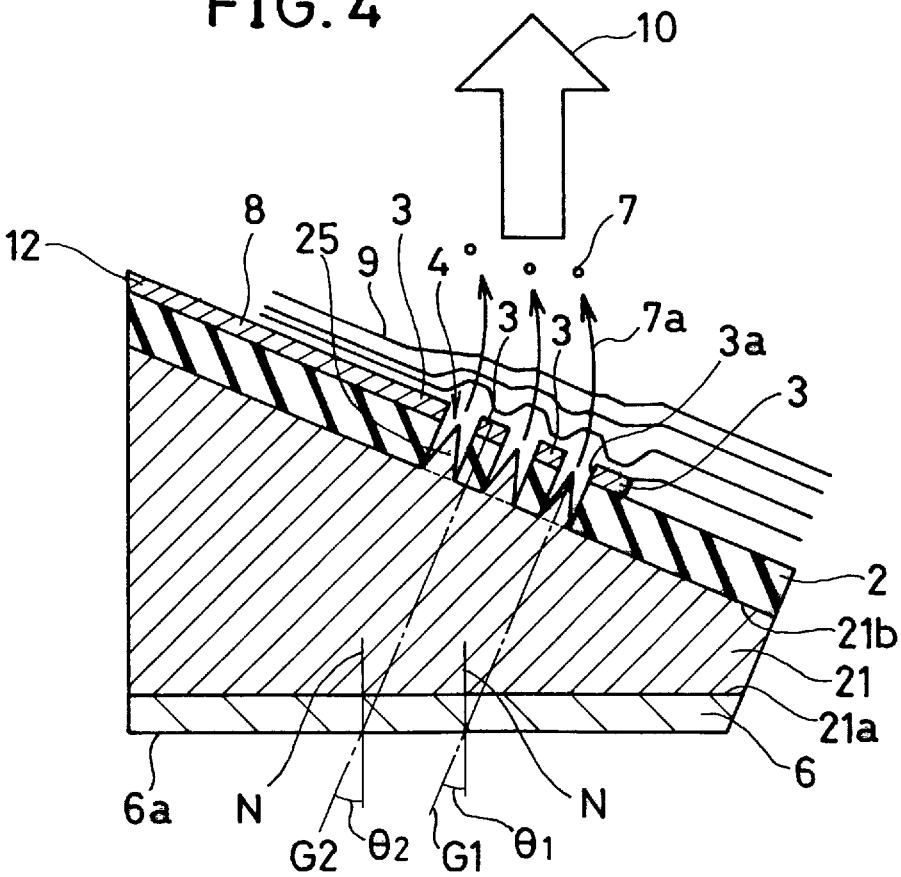
FIG. 4 is a schematic cross sectional view of a field emission device according to a second embodiment of the present invention, in which the gate electrode is oblique to the back surface of the substrate.

A field emission device according to a second embodiment is shown in FIG. 4, which is the same in configuration as that according to the first embodiment, except that cathodes 25 have the same structure as that of the conventional device shown in FIG. 1 and that a substrate 21 has upper and lower main surfaces not parallel to each other. Therefore, by adding the same reference characters to the corresponding elements in FIG. 4, the description relating to the same configuration is omitted here for the sake of simplification of description.

In the device according to the second embodiment, as shown in FIG. 4, the central axis G1 of each of the cathodes 25, which penetrates its tip, is perpendicular to an upper main surface 21*b* of the substrate. The central axis G1 is tilted by an angle $\theta_1$ with respect to a normal N of the lower main surface 21*a* of the substrate 21 or the surface 6*a* of the lower conductive layer 6 toward an opposite side (right-hand side in FIG. 3) to the second part or interconnection 8 of the conductive layer 12.

Further, the axis G2 of the gate electrode 3, which is perpendicular to the gate electrode 3 or upper conductive layer 12, is tilted an angle $\theta_2$ with respect to the normal N of the lower main surface of the substrate 21 toward the same side as that of the cathodes 25, where $\theta_1=\theta_2$.

Therefore, when a voltage is applied across the upper and lower conductive layers 12 and 6, the electrons 7 are emitted from the tip of the cathodes 25 to travel through the windows 3*a* of the gate electrode 3. The overall direction 10 of the emitted electrons 7 is inclined toward the side of the interconnection 8 with respect to the gate electrode 3. On the other hand, the axis G2 of the gate electrode 3 is tilted toward the opposite side of the interconnection 8 with respect to the gate electrode 3 to cancel the inclination of the emission direction 10 of the electrons 7. As a result, the resultant emission direction 10 of the electrons 7 can be parallel to the normal N of the lower main surface 21*a* of the substrate 21.

With the field emission device according to the second embodiment, there are the same advantages as those in the first embodiment.

The device according to the second embodiment has an additional advantage that it can be realized by simply polishing the lower main surface 21*a* of the substrate 21 so as to be tilted as shown in FIG. 4. In other words, with the device according to the second embodiment, the emission direction 10 of the electrons 7 can be more readily controlled by adjusting the tilt angles $\theta_1$ and $\theta_2$ compared with the first embodiment.

The tilt angles $\theta_1$ and $\theta_2$ are optionally determined in such a way that the traveling electrons 7 do not collide with the gate electrode 3, respectively.

Figure 5:
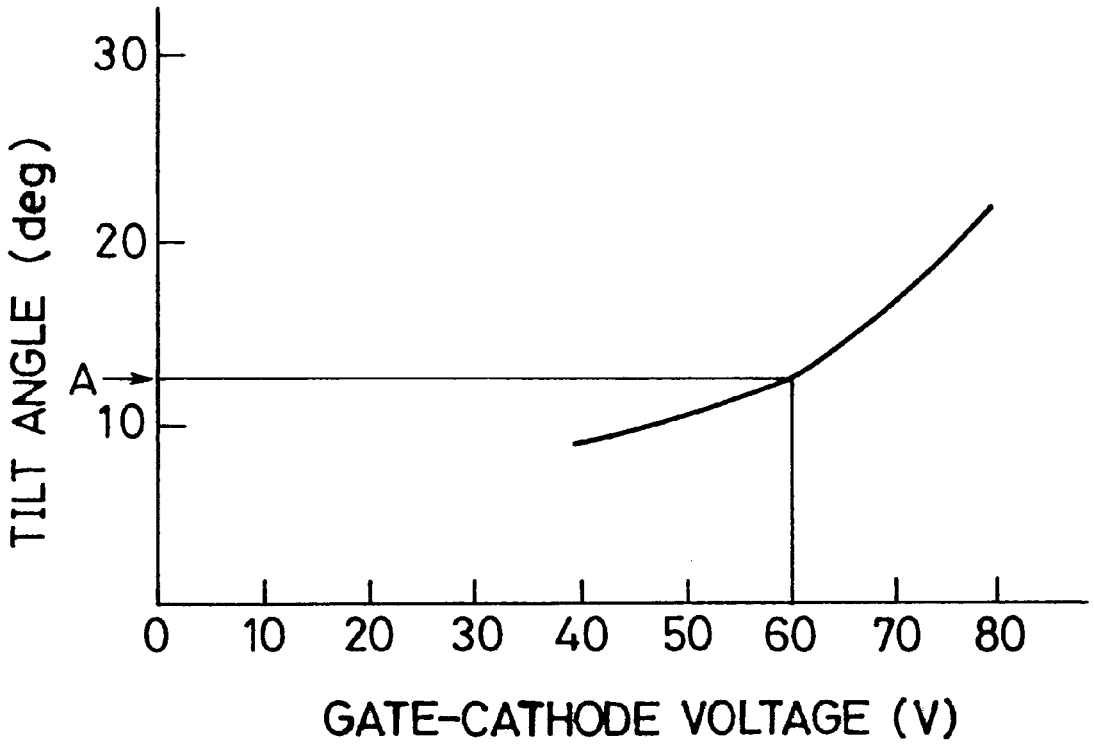
FIG. 5 is a graph showing the relationship between the gate-cathode voltage and the tilt angle of the cathode with respect to a normal of the back surface of the substrate in the conventional field emission device shown in FIG. 1.

FIG. 5 shows a graph showing the relationship between the gate-cathode voltage and the tilt angle of the cathode with respect to the normal of the lower main surface of the substrate in the conventional field emission device shown in FIG. 1. This graph was obtained through a test by the inventor under the following condition:

A phosphor screen (not shown) is fixed apart from the gate electrode 33 by 20 mm and opposite to the gate electrode 33. The upper conductive layer 42 has the same pattern as that in FIG. 2. A positive electric potential of 500 V is applied to the screen with respect to the potential on the gate electrode 33. The voltage between the gate electrode 33 and the cathodes 35 is measured while changing the tilt angle of a normal of the back electrode 36 or substrate 31 with respect to a vertical direction.

It is seen from FIG. 5 that the tilt angle becomes 12° at the point A where the corresponding gate-cathode voltage is 60 V. Therefore, if the field emission device according to the second embodiment is used under the condition of the gate-cathode voltage of 60 V, the lower main surface 21*a* of the substrate 21 should be polished in such a ay that the tilt angles $\theta_1$ and $\theta_2$ are equal to 12°.

Similarly, the tilt angle $\theta_1$ of the cathodes 5 is set as 12° in the device according to the first embodiment.

Additionally, if an anode with a pinhole or pinholes is provided in place of the phosphor screen, the electrons 7 satisfying the condition for a wanted value of the gate-cathode voltage can be selectively extracted.

The cathodes 25 may have the same structure as the tilted cathodes 5 of the first embodiment in such a way that the overall emission direction 10 of the electrons 7 is set in a wanted direction.

For example, a single-crystal silicon (Si) suibstrate with a square plan shape 2 mm×2 mm and an average thickness of 600 $\mu$m may be used as the substrate 21. A silicon dioxide ($SiO_2$) layer with a thickness of 1 $\mu$m may be used as the insulating layer 2. A polycrystalline tungsten (W) layer with a thickness of 200 nm may be used as the conductive layer 12. The bottom diameter of the cathode 25 may be 1 $\mu$m. The tilt angles $\theta_1$ and $\theta_2$ may be 7°.

While the preferred forms of the present invention has been described, it is to be understood that modifications will be apparent to those skilled in the art without departing from the spirit of the invention. The scope of the invention, therefore, is to be determined solely by the following claims.

What is claimed is:

1. A field emission device comprising:

a substrate with a first main surface and a second main surface;

an insulating layer formed on said first main surface of said substrate;

a first conductive layer (a) selectively formed on said insulating layer, and (b) having a plurality of windows formed therein;

said insulating layer having a like plurality of holes located just below said respective widows of said first conductive layer to expose portions of the first main surface of said substrate;

said first conductive layer having a first part serving as a gate electrode and a second part serving as an interconnection for said gate electrode;

said first conductive layer having an asymmetric plan shape with respect to said first part;

a plurality of cathodes formed on portions said exposed first main surface of said subtstrate and extending into respective holes of said insulating layer;

each said cathode having a conical shape having a central axis running between a bottom and tip thereof, the bottom of which is connected to said first main surface of said substrate and the tip of which is directed toward said gate electrode; and a second conductive layer formed on the second main surface of said substrate;

wherein the central axis of each said cathode (a) is tilted at an angle with respect to a normal of said second main surface of said substrate toward an opposite side to said second part of said first conductive layer, and (b) runs parallel to the other axes;

wherein electrons emitted from the tops of each said cathode travel through said windows of said first conductive layer on application of a voltage across said first conductive layer and said substrate; and wherein the direction of said emitted electrons is approximately parallel to said normal of said second main surface of said substrate.

2. The device as claimed in claim 1, wherein said first main surface of said substrate is parallel to said second main surface of said substrate;

and wherein the central axis of said cathode is tilted with respect to said first main surface of said substrate.

3. The device as claimed in claim 1, wherein said first main surface of said substrate is not parallel to said second main surface of said substrate;

and wherein the central axis of said cathode is perpendicular to said first main surface of said substrate.

4.The device as claimed in claim 1, wherein said cathodes are tilted at an angle of 5°.

5. The device as claimed in claim 1, wherein said cathodes are tilted at an angle of 7°.

6. The device as claimed in claim 1, wherein said cathodes are tilted at an angle of 12°.

* * * * *

UNITED STATES PATENT AND TRADEMARK OFFICE

CERTIFICATE OF CORRECTION

PATENT NO. : 6,057,642
DATED : May 2, 2000
INVENTOR(S) : Kazuo Konuma

It is certified that error appears in the above-identified patent and that said Letters Patent is hereby corrected as shown below:

Column 7, claim 1,
Line 44, change "widows" to -- windows --.

Column 8, claim 1,
Line 10, insert -- a -- before "tip".

Signed and Sealed this

Nineteenth Day of March, 2002

*Attest:*

*Attesting Officer*

JAMES E. ROGAN
*Director of the United States Patent and Trademark Office*